US010030440B2

(12) United States Patent
Fonville

(10) Patent No.: US 10,030,440 B2
(45) Date of Patent: Jul. 24, 2018

(54) VENETIAN BLIND

(71) Applicant: Mare Beheer B.V., Haren (NL)

(72) Inventor: Eric Maria Fonville, Haren (NL)

(73) Assignee: Mare Beheer B.V., Haren (NL)

( * ) Notice: Subject to any disclaimer, the term of this patent is extended or adjusted under 35 U.S.C. 154(b) by 103 days.

(21) Appl. No.: 15/103,780

(22) PCT Filed: Dec. 15, 2014

(86) PCT No.: PCT/NL2014/050861
§ 371 (c)(1),
(2) Date: Jun. 10, 2016

(87) PCT Pub. No.: WO2015/088349
PCT Pub. Date: Jun. 18, 2015

(65) Prior Publication Data

US 2016/0312529 A1 Oct. 27, 2016

(30) Foreign Application Priority Data

Dec. 13, 2013 (NL) ..... 2011962
Jan. 22, 2014 (EP) ..... 14152149

(51) Int. Cl.
*E06B 9/26* (2006.01)
*E06B 9/384* (2006.01)
(Continued)

(52) U.S. Cl.
CPC ..... *E06B 9/384* (2013.01); *E06B 9/307* (2013.01); *E06B 9/386* (2013.01)

(58) Field of Classification Search
CPC ..... E06B 2009/2452; E06B 2009/285; E06B 2009/3222; E06B 7/08; E06B 9/02;
(Continued)

(56) References Cited

U.S. PATENT DOCUMENTS 1,929,071 A * 10/1933 Levy ..... E06B 9/303 160/169
2,111,979 A 11/1934 Lawson
(Continued)

FOREIGN PATENT DOCUMENTS

AU 2003261480 4/2004
DE 837171 4/1952
(Continued)

OTHER PUBLICATIONS

International Search Report for PCT/NL2014/050861 dated Mar. 25, 2015.

*Primary Examiner* — Katherine W Mitchell
*Assistant Examiner* — Jeremy C Ramsey
(74) *Attorney, Agent, or Firm* — Pillsbury Winthrop Shaw Pittman, LLP

(57) ABSTRACT

Venetian blind with horizontal slats suspended via carriers. The carriers extend through openings in the slats and include supports each supporting a slat adjacent one of the openings. The openings and the supports are arranged for providing stable support for each of the slats in at least two, mutually distinct positions. The orientations of individual slats or of subgroups of the slats can be adjusted very quickly by directly engaging the slats to be adjusted with a hand or an operating member between a limited number of predefined orientations. An orderly visual appearance can be achieved easily, even though the orientations of the slats are adjusted individually, since slats intended to be in the same orientation automatically assume mutually identical orientations.

15 Claims, 16 Drawing Sheets

(51) Int. Cl.
*E06B 9/307* (2006.01)
*E06B 9/386* (2006.01)

(58) Field of Classification Search
CPC ..... E06B 9/0638; E06B 9/26; E06B 9/266; E06B 9/28; E06B 9/302; E06B 9/303; E06B 9/32; E06B 9/326; E06B 9/38; E06B 9/384; E06B 9/386; E06B 9/388
USPC ..... 160/115, 166.1, 167 R, 174 R, 175, 160/176.1 R, 177 R, 184; 49/403, 74.1, 49/80.1, 92.1
See application file for complete search history.

(56) References Cited

U.S. PATENT DOCUMENTS

| | | | | | |
|---|---|---|---|---|---|
| 2,169,873 | A | | 5/1938 | Clark | |
| 2,263,540 | A | | 7/1940 | Johnson | |
| 2,579,485 | A | * | 12/1951 | Ferguson | E06B 9/384 160/115 |
| 3,032,151 | A | | 10/1959 | Allen et al. | |
| 4,590,886 | A | * | 5/1986 | Brashear | A61D 3/00 119/519 |
| 4,911,220 | A | | 3/1990 | Hiller | |
| 4,961,729 | A | | 8/1990 | Chi Yu | |
| 5,101,876 | A | | 4/1992 | Zak | |
| 5,141,042 | A | | 8/1992 | Schwaegerle | |
| 5,165,459 | A | * | 11/1992 | Gaber | E06B 9/30 160/168.1 R |
| 5,375,642 | A | * | 12/1994 | Gaber | E06B 9/302 160/168.1 R |
| 5,829,506 | A | | 11/1998 | Zorbas | |
| 5,850,861 | A | * | 12/1998 | Silverberg | E06B 9/264 160/107 |
| 6,305,454 | B1 | * | 10/2001 | Judkins | E06B 9/322 160/113 |
| 6,510,806 | B1 | | 1/2003 | Krieck | |
| 6,598,650 | B1 | | 7/2003 | Palmer | |
| 2002/0003027 | A1 | | 1/2002 | Swiszcz et al. | |
| 2002/0040770 | A1 | | 4/2002 | Colson et al. | |
| 2002/0088559 | A1 | | 7/2002 | Green et al. | |
| 2003/0127196 | A1 | * | 7/2003 | Corey | E06B 9/32 160/84.05 |
| 2007/0151678 | A1 | | 7/2007 | Chen | |
| 2012/0255476 | A1 | | 10/2012 | Walker et al. | |

FOREIGN PATENT DOCUMENTS

| | | |
|---|---|---|
| DE | 1943605 U | 8/1966 |
| DE | 3130541 | 2/1983 |
| DE | 3207850 | 9/1983 |
| DE | 29722219 | 3/1998 |
| DE | 197 45 925 | 4/1999 |
| DE | 19924882 | 2/2001 |
| DE | 10 2009 004287 | 7/2010 |
| EP | 0 228 937 | 7/1987 |
| EP | 1 321 621 | 6/2003 |
| GB | 623 832 | 5/1949 |
| GB | 948232 | 1/1964 |
| JP | 62-21298 | 2/1987 |
| JP | H 3-96591 | 4/1991 |
| JP | H 5-280271 | 10/1993 |
| JP | H 6-346672 | 12/1994 |
| JP | H 7-4156 | 1/1995 |
| JP | 2000-186476 | 7/2000 |
| JP | 2001-12173 | 1/2001 |
| JP | 2008-285943 | 11/2008 |
| NL | 2000479 | 8/2008 |
| WO | WO 2009/074280 | 6/2009 |

* cited by examiner

VENETIAN BLIND

CROSS-REFERENCE TO RELATED APPLICATIONS

This is the U.S. National Stage of PCT/NL2014/050861, filed Dec. 15, 2014, which in turn claims priority to Netherlands Application No. 2011962, filed Dec. 13, 2013 and European Application No. 14152149.2, filed Jan. 22, 2014, the entire contents of all applications are incorporated herein by reference in their entireties.

FIELD AND BACKGROUND OF THE INVENTION

The invention relates to a venetian blind. A venetian blind is a type of window blind, also known as a window shade, for covering a window. Window blinds exist in many forms. In venetian blinds, horizontal slats are provided in a mutually parallel arrangement generally extending in a plane parallel to the plane of the window to be covered. The angle of the slats relative to the plane of the window to be covered can be adjusted to adjust the extent to which light can pass through the cover. Conventionally, venetian blinds typically have flexible ladders in which the slats are suspended between ladder cords or tapes in a succession extending generally parallel to the window plane to be covered, usually in a vertical succession. The orientation of the slats about longitudinal axes thereof is typically controlled by rotating drums and/or pulleys in unison such that the ladder cords or tapes on one side are slightly pulled up at their top ends and ladder cords or tapes on the opposite side are slightly lowered. Thus, the slats are tilted in unison.

For lifting the venetian blind, usually lift cords extend centrally between the ladder cords or tapes through openings in the slats from a bottom beam, via pulleys and cleats in a top beam from which free ends of the lift cords hang down and can be operated by a user to be pull up the venetian blind to a lifted configuration allowing essentially free view and light passage through the window or to lower the venetian blind to a lowered position covering the window, but allowing more or less vision and light passage through the venetian blind, depending on the orientation of the slats. When the lift cords are pulled, the bottom beam of the blind moves upward entrains the lowest slat and successively each next slat on top of the entrained one, which can be continued until all slats are tightly stacked against the upper beam of the blind.

Venetian blinds can to some extent shield the interior of a building from heat or cold, reduce the influx of light to varying degrees and provide privacy by preventing shielding an interior behind the blind from being visible from the outside.

A disadvantage of conventional venetian blinds is that all slats are always in the same orientation. While this is desirable from the point of view of obtaining a uniform structure throughout the effective surface of the venetian blind, it does not allow to combine for instance a tilted positions of slats in a lower or central portion of the venetian blind, for instance for privacy and/or shielding plants from direct sun light, with a horizontal orientation of slats in an upper portion of the venetian blind allowing a to a large extent free entry of daylight through that upper portion. Generally, blocking light passage through an upper portion while allowing free view (out) through a lower portion is in principle possible by partially lifting the venetian blind, but this results in a completely uncovered lower portion of the window and a visually less attractive configuration with the lower beam extending more or less centrally across the window.

SUMMARY OF THE INVENTION

It is an object of the present invention to provide a venetian blind with a plurality of horizontal slats of which the orientation can be adjusted individually or in subgroups of the slats in an easy manner.

According to the invention, this object is achieved by providing a venetian blind having a plurality of slats elongate in a horizontal direction, suspended via and evenly distributed along carriers elongate in directions with a vertical component, so as to form a window cover having a horizontal size determined by the length of the slats and a size perpendicular thereto determined by the length of the carriers, wherein the carriers extend through openings in the slats, comprise supports positioned with a pitch along the carriers, each support supporting a slat adjacent to an opening, the openings and the supports being arranged for providing stable support for each of the slats in at least two, mutually distinct positions. The invention can also be embodied in a use of such a venetian blind as a cover of a window extending parallel to said slats and to said carriers.

Because the openings and the supports are arranged for providing stable support for each of the slats in at least two distinct positions, the slats each being movable individually between said positions, the orientations of individual slats or of subgroups of the slats can be adjusted very quickly by directly engaging the slats to be adjusted with a hand or an operating member such as a stick or a broom. A swiping movement in a suitable direction along the slats to be adjusted will typically be sufficient for imparting the desired movement from one orientation to the other. Since the slats are adjustable between a limited number of predefined orientations, an orderly visual appearance can be achieved easily, even though the orientations of the slats are adjusted individually. Because the slats assume one of a limited number of predefined orientations, slats intended to be in the same orientation automatically assume mutually identical orientations.

Particular elaborations and embodiments of the invention are set forth in the dependent claims.

Further features, effects and details of the invention appear from the detailed description and the drawings.

DETAILED DESCRIPTION

Figure 1:
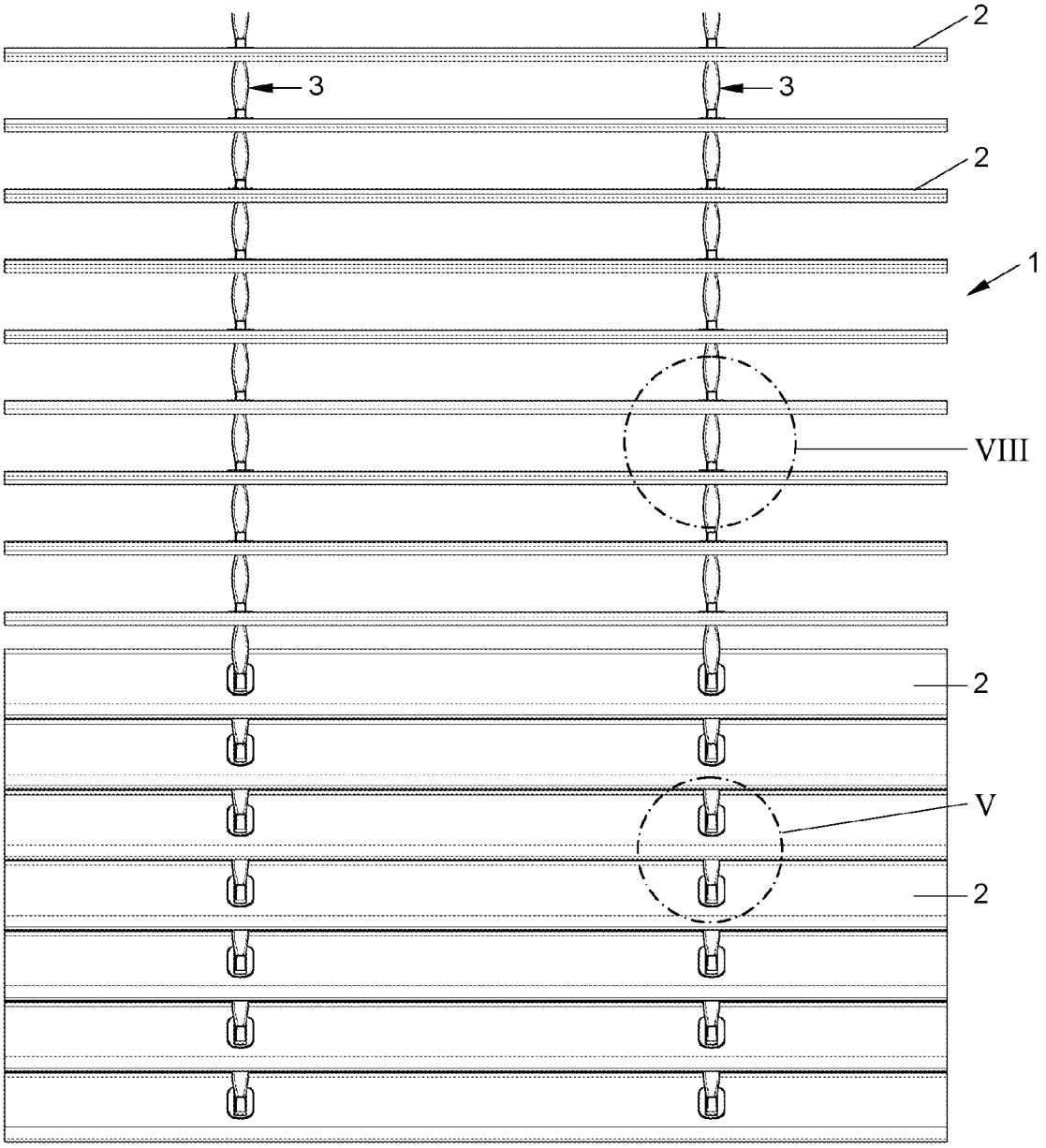
FIG. 1 is a schematic frontal view of an example of a venetian blind according to the invention.

Various aspects of the invention are first discussed with reference to a first example of a venetian blind shown in FIGS. 1-13.

A venetian blind 1 has a plurality of slats 2 (of which, in FIGS. 1 and 2, only a few are designated by a reference numeral) that are each elongate in a horizontal direction. The slats 2 are suspended via and evenly distributed along carriers 3 that are elongate in directions with a vertical component, so as to form a window cover having a horizontal size determined by the length of the slats 2 and a size perpendicular thereto determined by the length of the carriers 3. In the present example two carriers 3 carry the slats. However, depending on the length and stiffness of the slats, more carriers can be provided. The carriers 3 may have a flexible core in the form of a string, such as a twined or braided cord or a single filament or in the form of a tape or chain. The number of slats 2 will depend on the height of the window cover to be provided and the pitch (distance between corresponding parts of successive mutually identical items) between successive slats 2. The latter will in turn depend on the width of the slats and the degree of light blocking and/or shielding from view that is desired with the slats in horizontal (upper slats 2 in FIGS. 1 and 2) and/or laterally inclined (lower slats 2 in FIGS. 1 and 2) orientations.

The carriers 3 extend through openings 4 in the slats 2 and are provided with supports 5 positioned in a succession with a pitch p along the carriers 3. Each support 5 supports a slat 2 adjacent to an opening 4. The openings 4 and the supports 5 are arranged for providing stable support for each of the slats 2 in at least two distinct positions. The slats 2 are each being movable between these positions by lateral movement transverse to the carrier 3 and lateral tilting, i.e. tilting about an axis in longitudinal direction of the slat 2.

Figure 2:
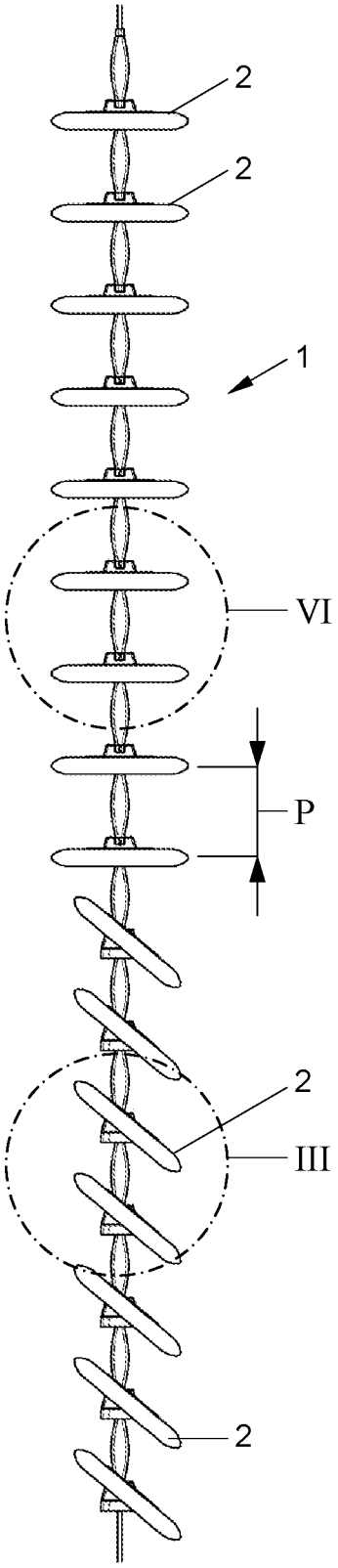
FIG. 2 is a schematic side view of the venetian blind shown in FIG. 1.
Figure 3:
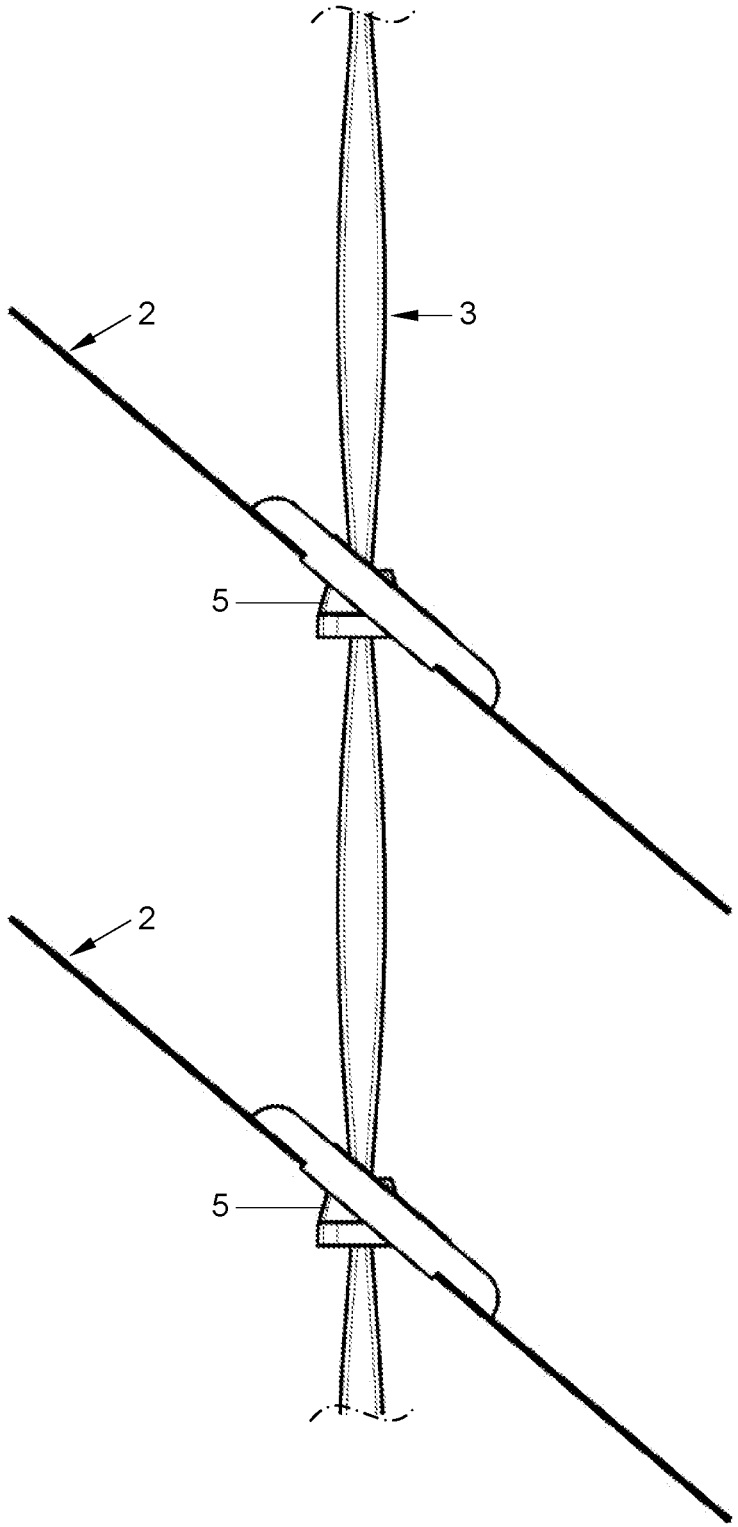
FIG. 3 is a side view of a portion of the venetian blind of FIGS. 1 and 2 including two slats in a laterally inclined orientation.
Figure 4:
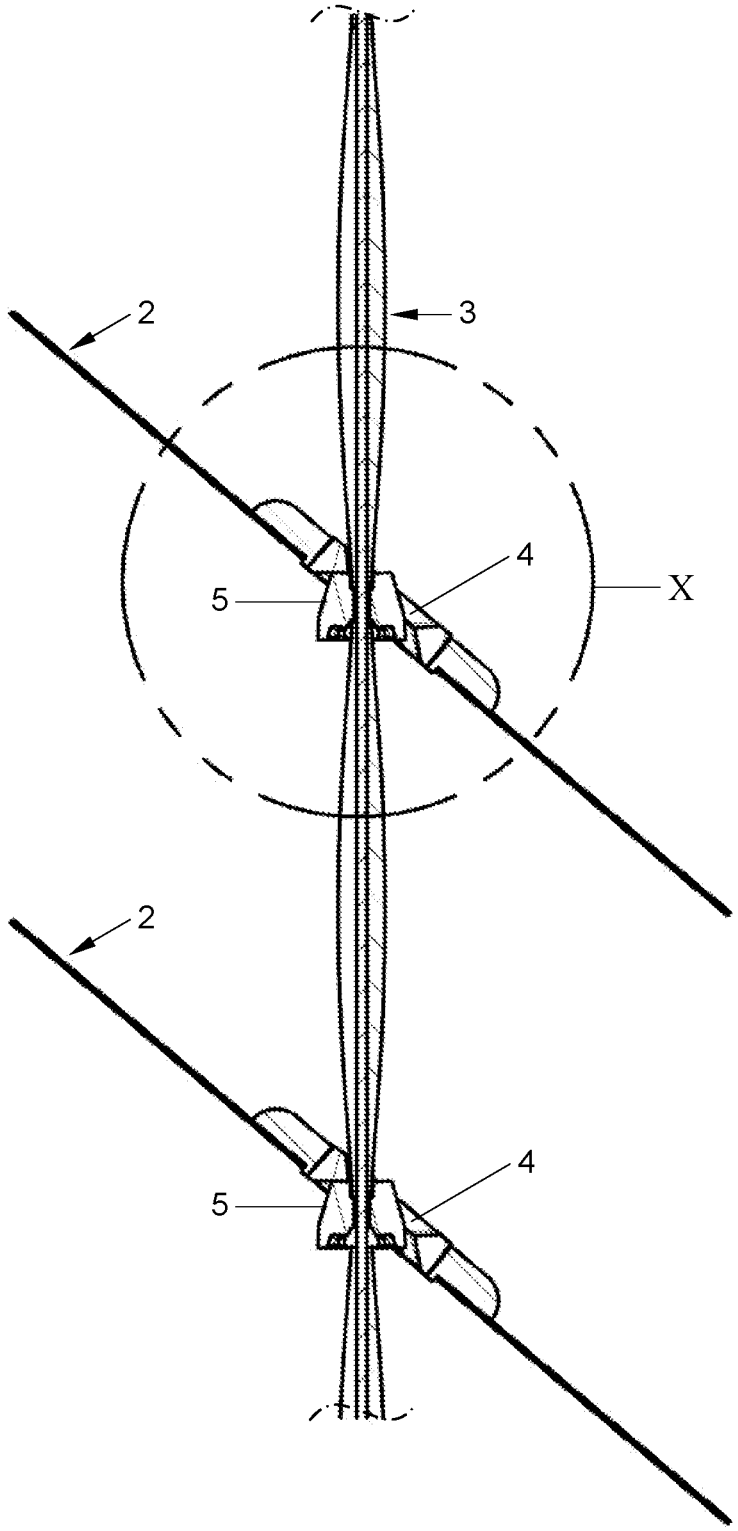
FIG. 4 is a side view in cross-section along the line IV-IV in FIG. 5.
Figure 5:
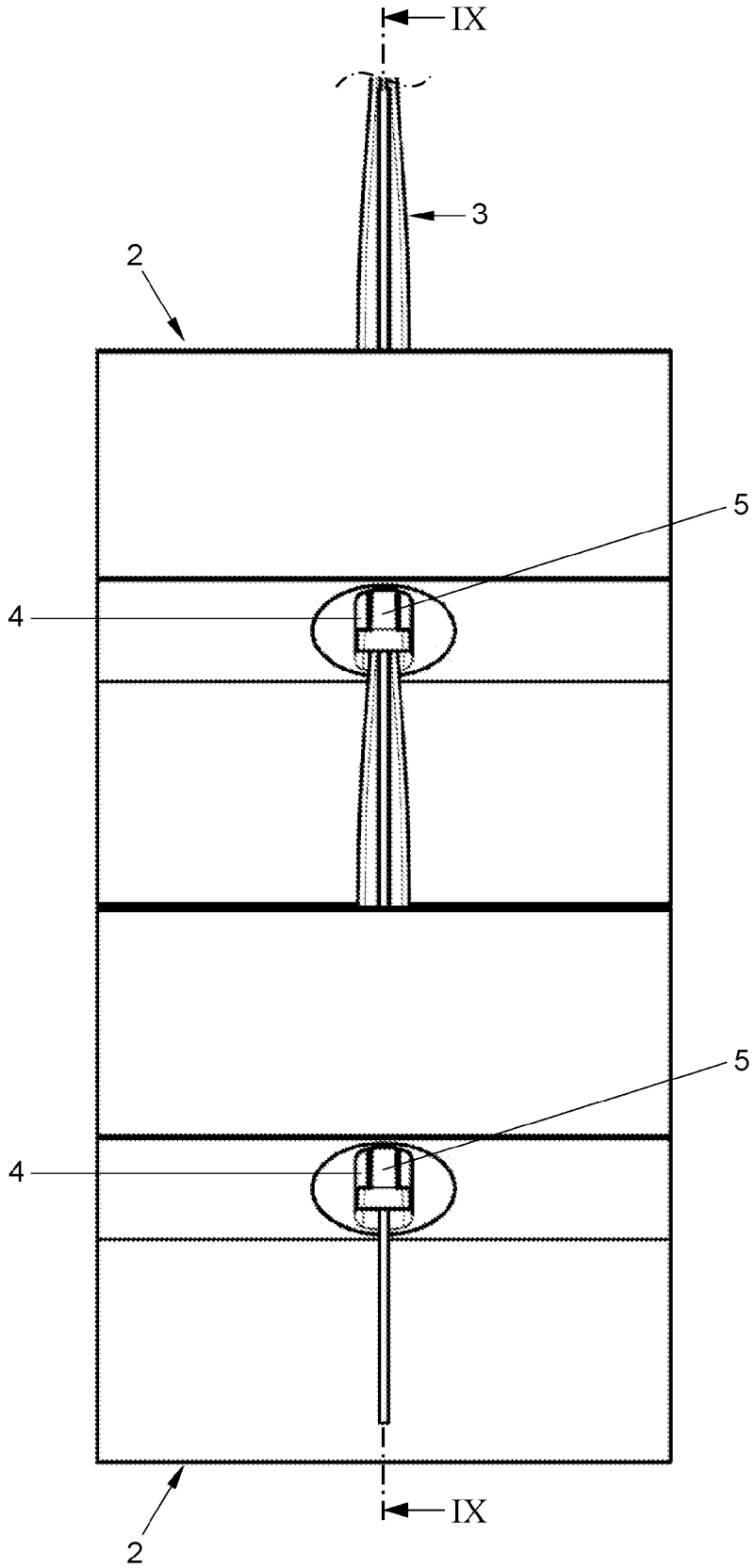
FIG. 5 is an enlarged view of portion V of FIG. 1
Figure 6:
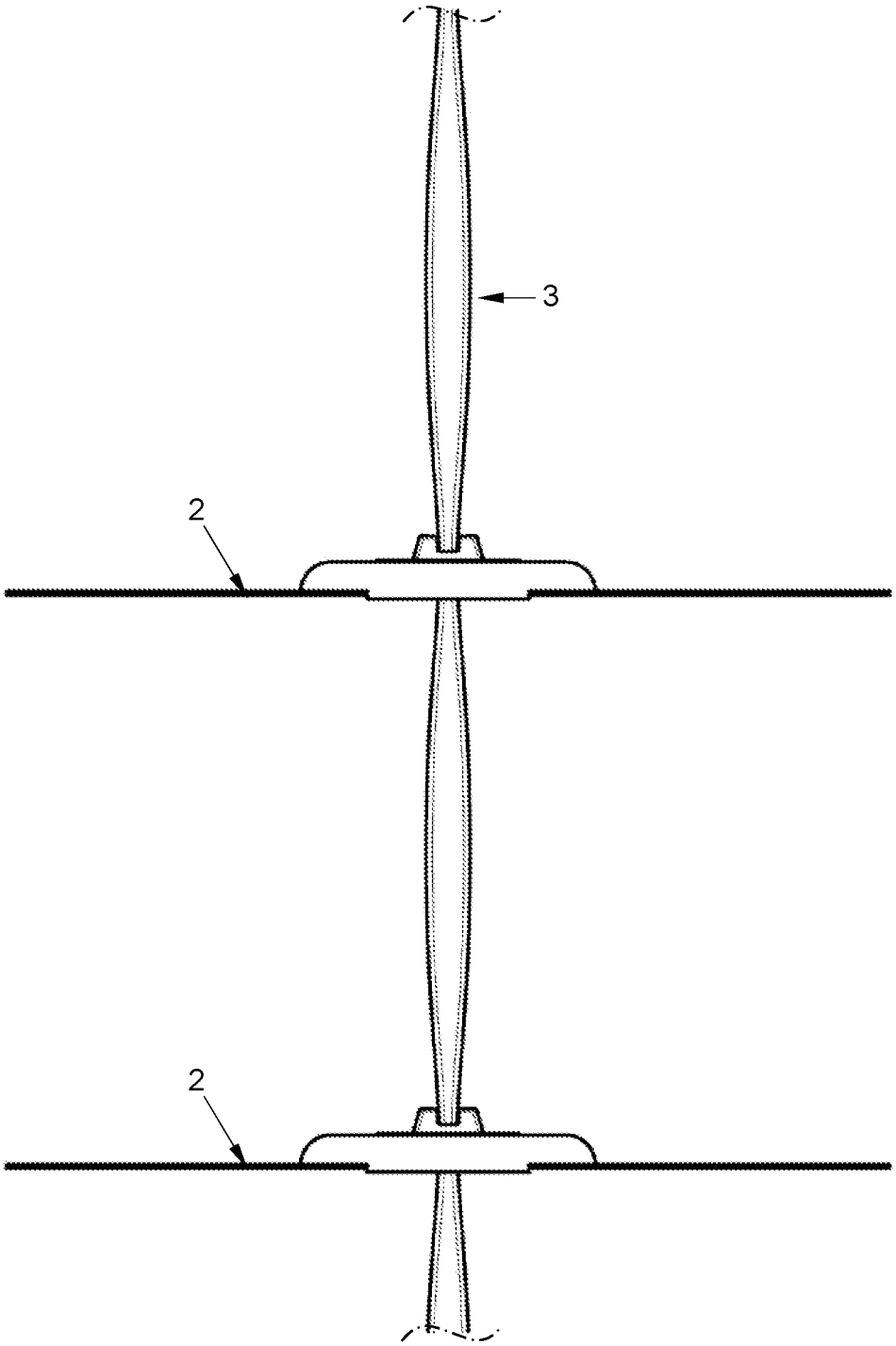
FIG. 6 is a side view in cross-section of the venetian blind of FIGS. 1-5 including two slats in a laterally horizontal orientation.
Figure 7:
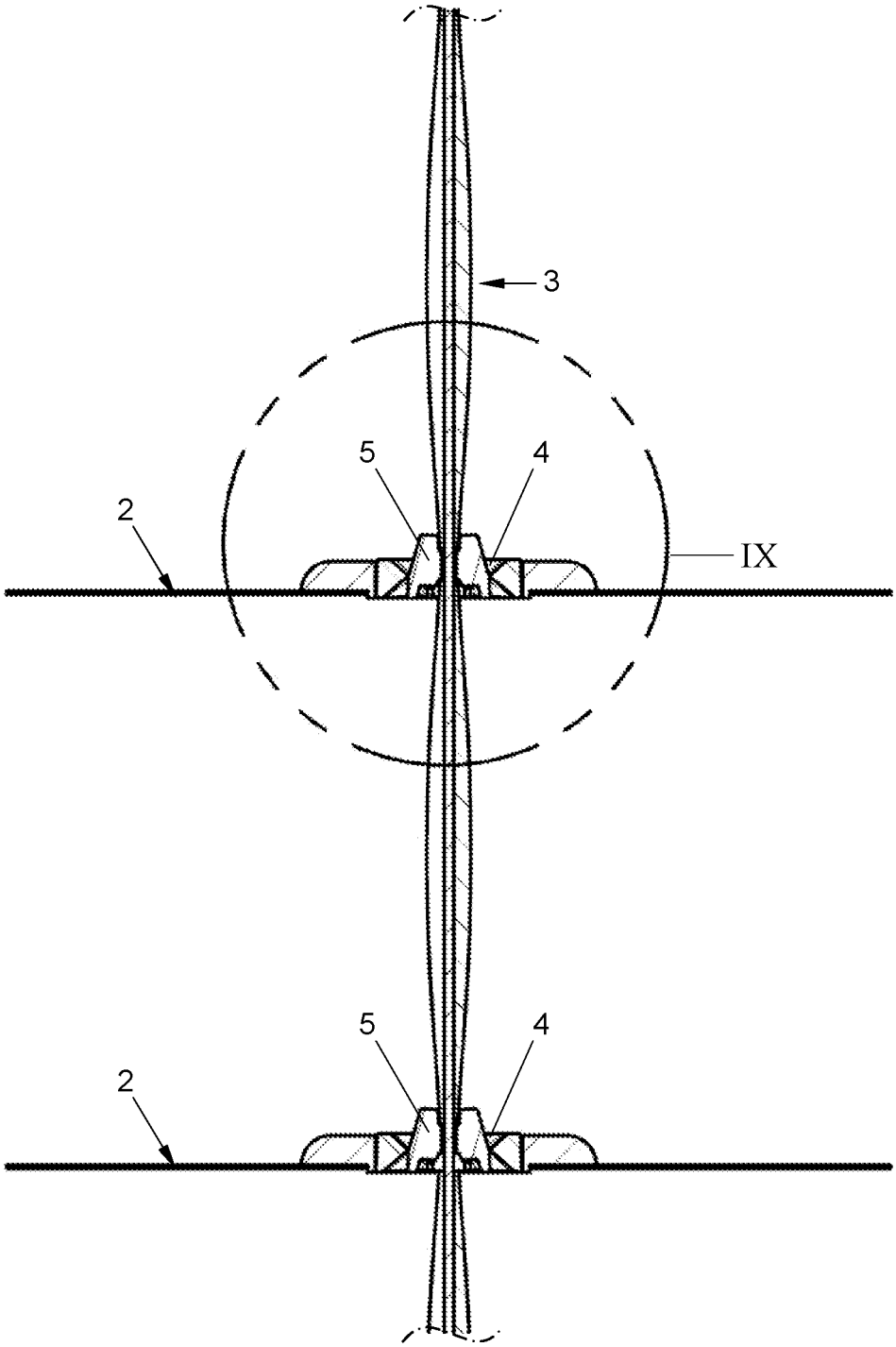
FIG. 7 is a side view in cross-section along the line VII-VII in FIG. 8.
Figure 8:
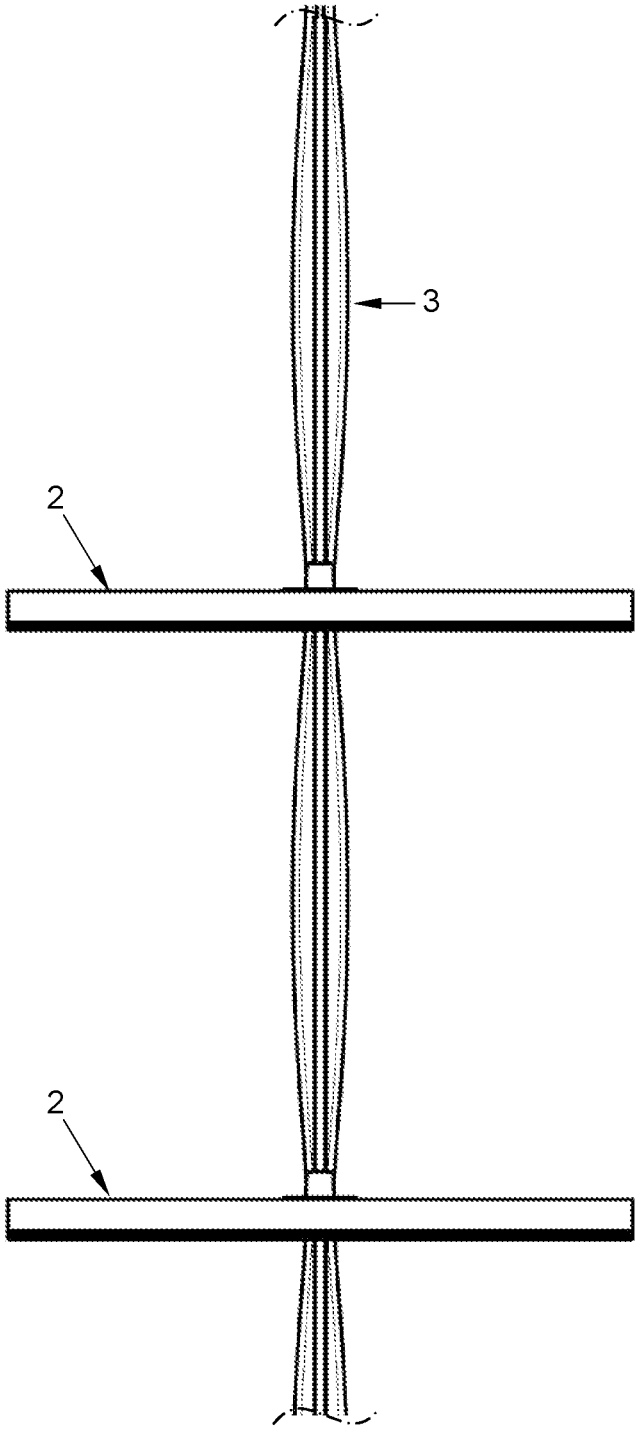
FIG. 8 is an enlarged view of portion VIII of FIG. 1.

In the present example, the slats are tiltable between a laterally horizontal orientation as shown in FIGS. 1 and 2 for the upper slats 2 and in FIGS. 6-9 and two laterally inclined orientations of which one is shown for the lower slats in FIGS. 1 and 2 and in FIGS. 3-5 and 10 and the other constitutes a position in which the slats are inclined in the opposite sense of the lateral inclination shown. By allowing different slats 2 or the slats 2 of different sections to be oriented differently, different sections of a window cover can be adjusted for different functions with respect to light transmission and blocking of view through the window cover. For instance, a relatively large portion of the light can be admitted through an upper portion of the window cover by setting the slats 2 of the upper portion in a horizontal or inwardly inclined orientation, while a lower portion of the window cover can be adjusted for blocking the interior behind the window from view from the outside and/or for protecting plants and flowers from exposure to direct sunlight by setting the slats 2 of the lower portion or of a lower central portion in an outwardly inclined orientation. Alternatively, heating up of an interior space can be counteracted by blocking most of the light from passing through an upper portion of the window cover by setting the slats 2 of the upper portion in an outwardly inclined orientation while allowing relatively undisturbed view out of the window by setting the slats 2 of the lower portion or of a lower central portion in a horizontal orientation.

Because the openings 4 and the supports 5 are arranged for providing stable support for each of the slats 2 in at least two distinct positions and the slats 2 are each movable between these positions by lateral movement transverse to the carrier 3 and lateral tilting, the orientation of individual slats 2 or subgroups of the slats 2 can be adjusted very quickly by directly engaging the slats 2 to be adjusted with a hand or an operating member such as a stick or a broom. A swiping movement in a suitable direction along the slats 2 to be adjusted will typically be sufficient for imparting the desired movement from one position to the other. Since the slats 3 are adjustable between a limited number (for instance 2, 3, 4 or 5) predefined, mutually distinct orientations, an orderly visual appearance can be achieved easily, even though the orientations of the slats 2 are adjusted individually. Because the slats 2 assume one of a limited number of predefined orientations, slats 2 intended to be in the same orientation can easily be brought in mutually identical orientations.

Adjustment of the orientation of the slats 2 can be made with particular ease, because the slats 2 rest freely on the supports 5, i.e. by gravity only. It is however also conceivable to provide that the slats are biased against the supports by elastic members. Such solutions can be advantageous is situation in which relatively strong currents of air can be expected and/or in which the window blind is mounted to a movable window panel.

It is further noted, that in the present example, the carriers 3 are oriented vertically. It is also possible to provide that the carriers are oriented with a horizontal directional component as well, for instance obliquely along a window in an inclined roof. This may require the orientation of the supports relative to the carriers to be adjusted accordingly, at least to some extent.

Figure 9:
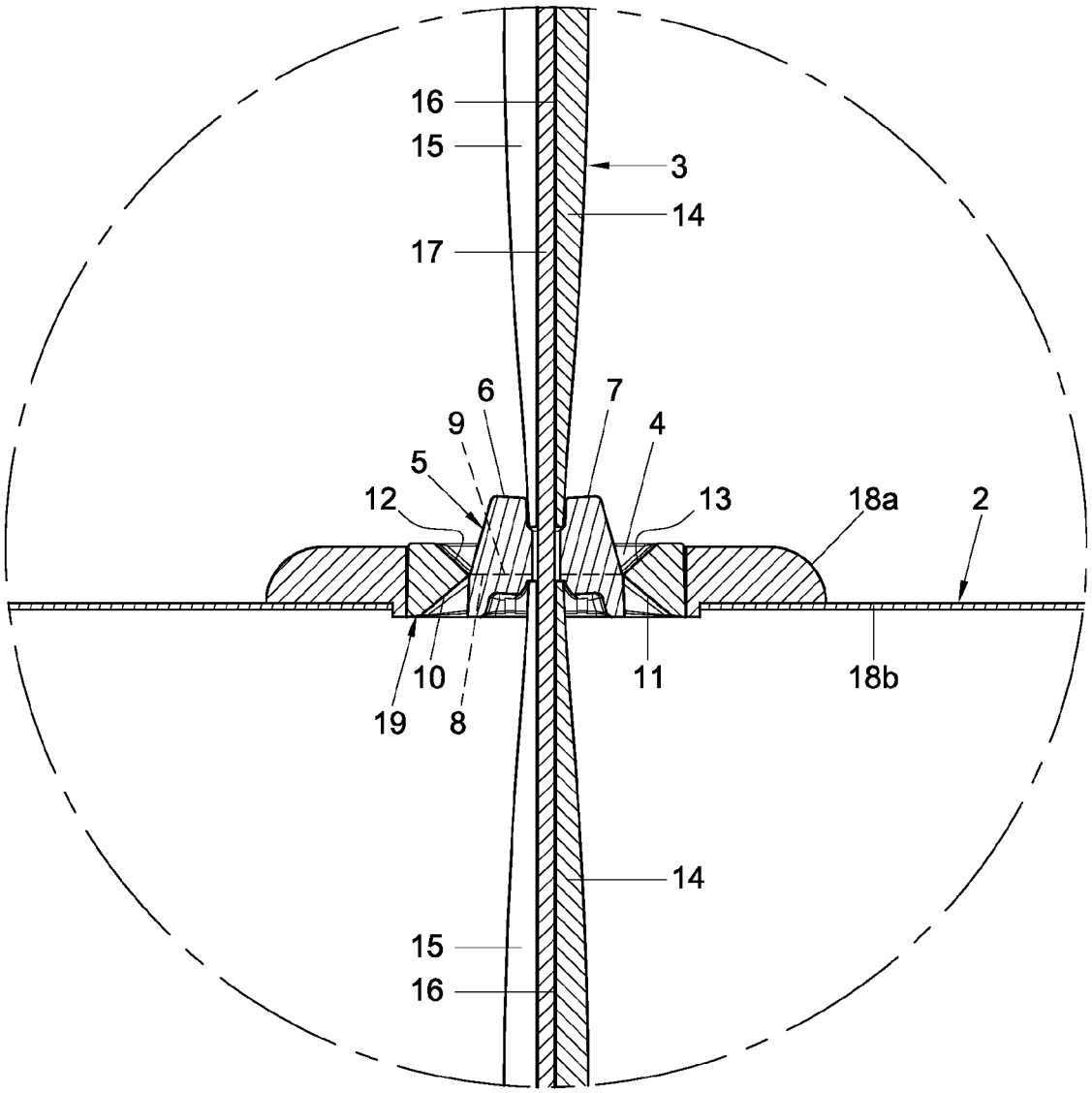
FIG. 9 is an enlarged view of portion IX of FIG. 7.
Figure 10:
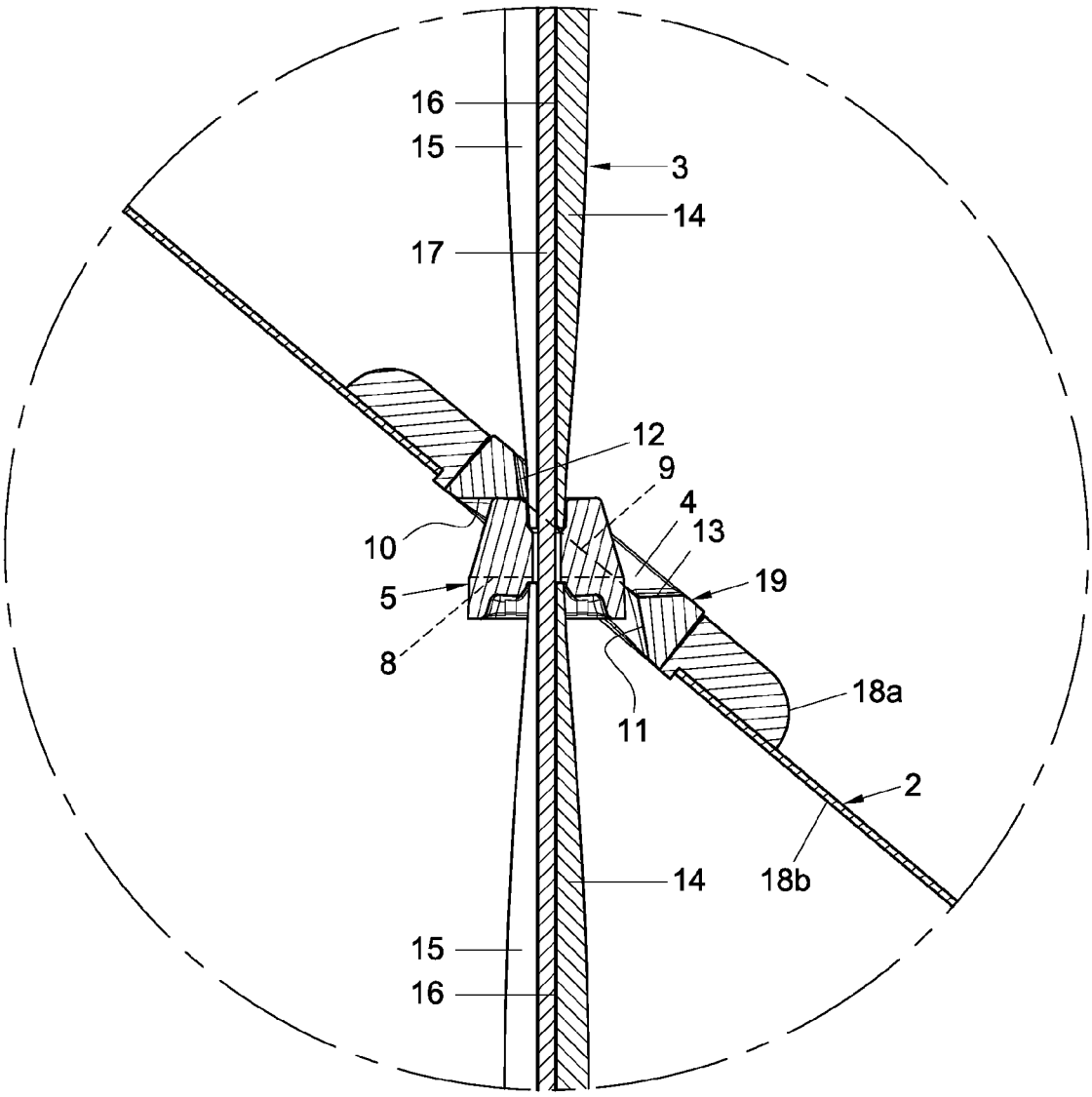
FIG. 10 is an enlarged view of portion X of FIG. 4.
Figure 11:
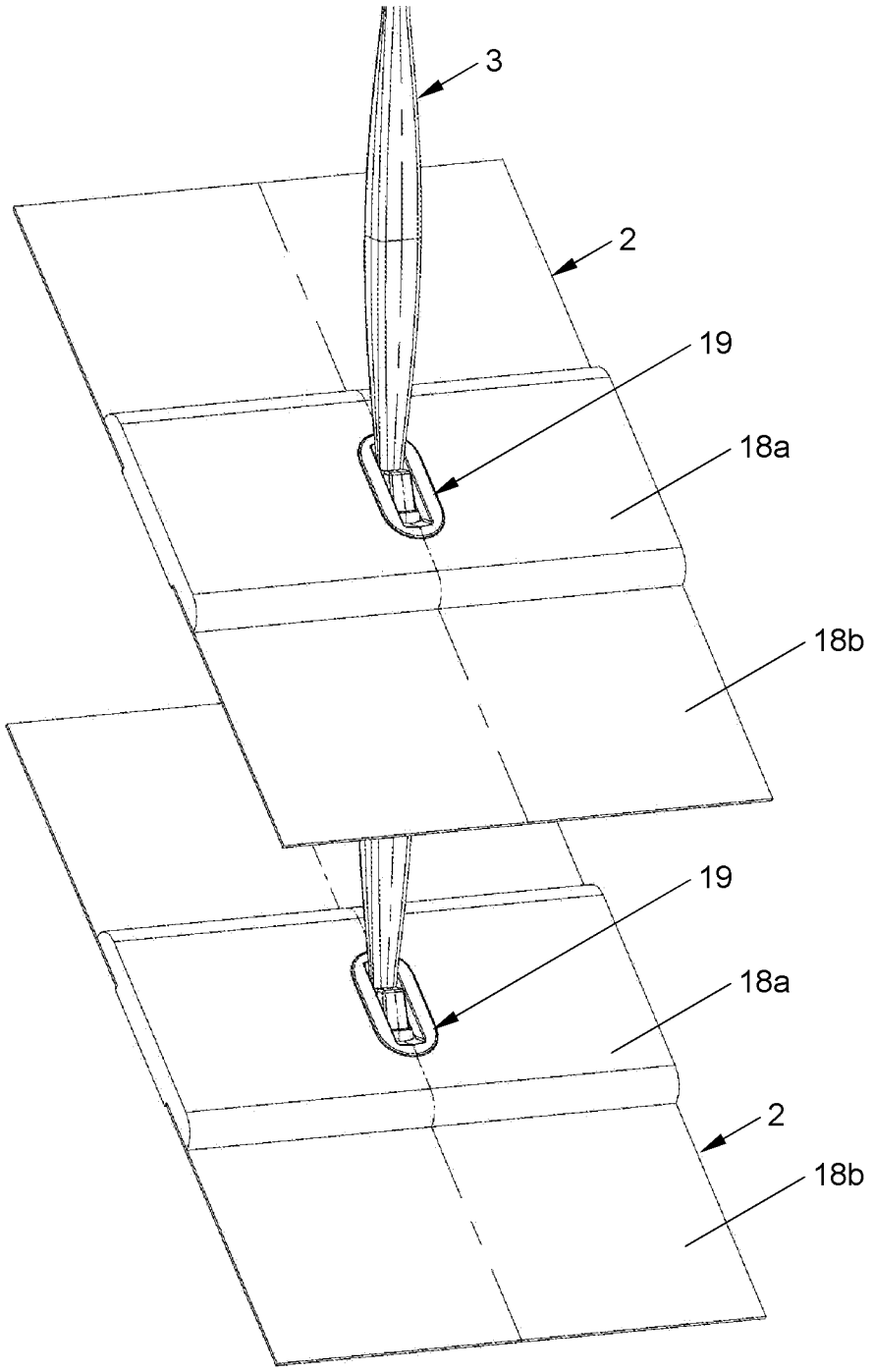
FIG. 11 is a perspective view of the portion of the venetian blind as shown in FIGS. 3-5.
Figure 12:
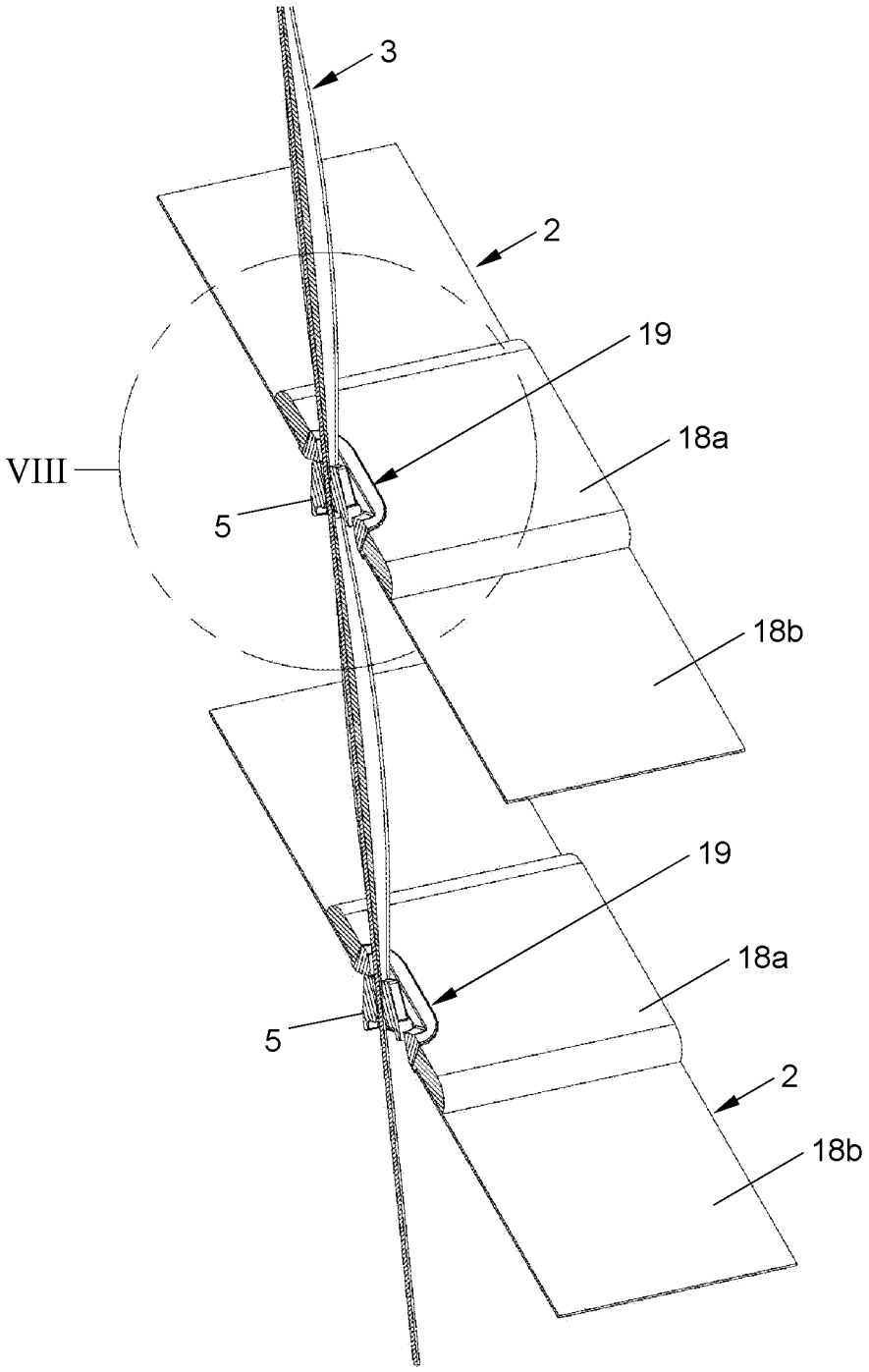
FIG. 12 is a perspective view in cross-section along the line IV-IV in FIG. 5.
Figure 13:
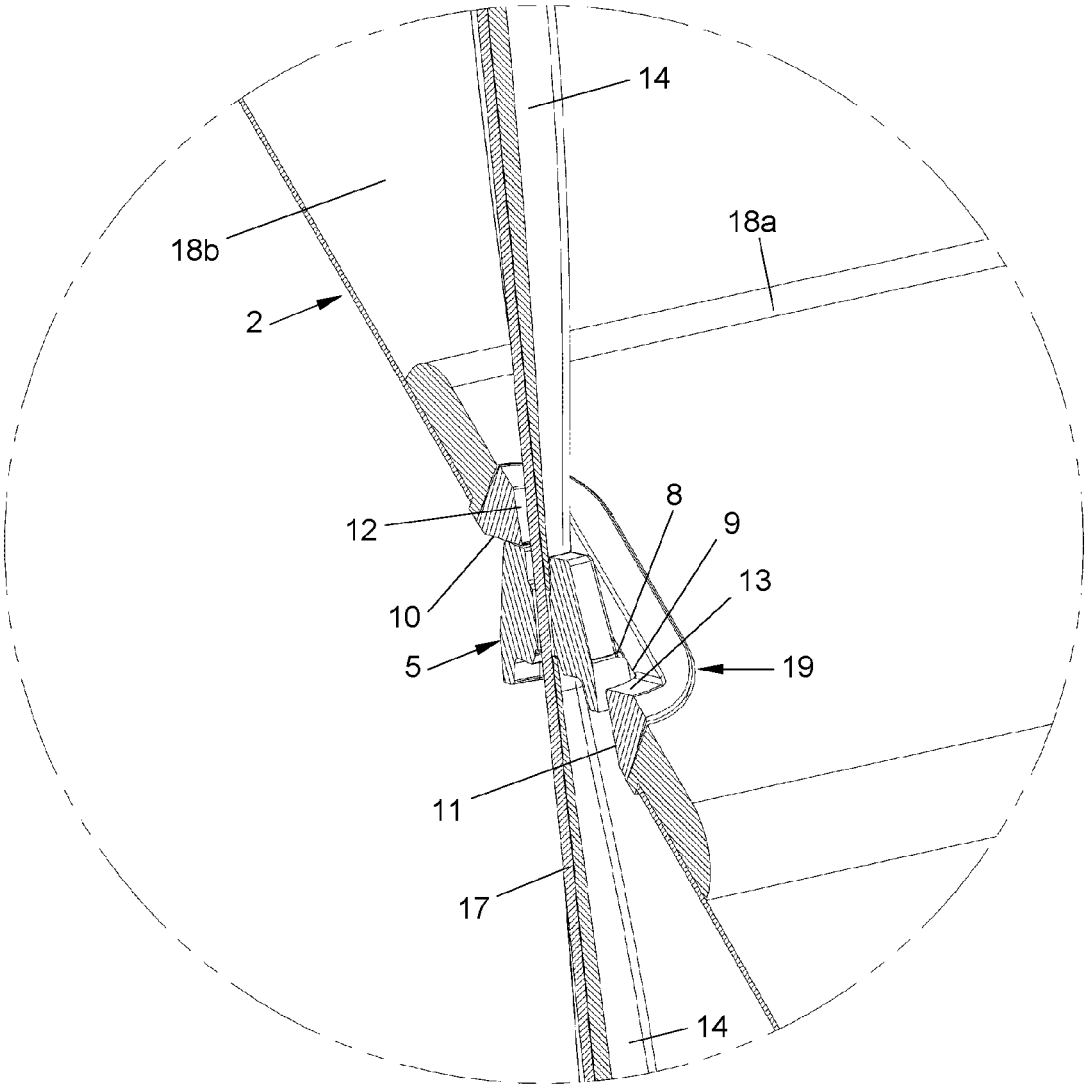
FIG. 13 is an enlarged view of a portion XIII in FIG. 12.

In the present example, each support 5 has shoulder 6, 7 at first and (opposite) second lateral sides of the carrier 3 (see FIGS. 9 and 10). The supports 5 further have support surfaces 8 facing upwardly and having portions at the first and second lateral side of the carrier 3. As is best seen in FIGS. 10 and 13, while the slat 2 is supported by the support 5 in a laterally inclined position, a surface portion 10 of the slat 2 adjacent to the opening 4 on the first side of the carrier 3 rests on the shoulder 6 and a surface portion 9 of the slat 2 adjacent to the opening 5 on the second side of the carrier 3 rests against the support surface 8 of the support 5 at that second side of the carrier 3.

The openings 4 in the slats 2 include elongate narrowest portions. The shoulders 6, 7 are of a width in longitudinal direction of the slats smaller than the narrowest width of the openings 4 in longitudinal direction of the slats, so that the shoulders 6, 7 project through the openings 4 when the slats 2 are in the laterally horizontal position as shown in FIGS. 6-9. For supporting the slats 2 in this position, the upwardly facing support surfaces 8 span a width in longitudinal direction of the slats larger than the width of the openings 4 in longitudinal direction of the slats, so that slats 2 are prevented from slipping off the supports 5. When the slats 2 are in the laterally inclined positions, one edge of the opening 4 rests on one of the shoulders 6, 7, while the other one of the shoulders 7, 6 projects into the opening 4 and, on a side of the carrier 3 opposite of the shoulder 6, 7 on which the slat 2 rests, the a surface 9 of the slat 2 adjacent to the opening 4 rests on an edge of the support surface 8.

The slat 2 can be brought in such an inclined orientation very easily, by lifting the slat 2 on the first side (which can also be achieved by pushing it down on the opposite, second side) until the surface portion 10 of the slat 2 adjacent to the opening 4 on the first side of the carrier 3 is at a level higher than the level of the upper surface of the shoulder 6. By urging the slat 2 laterally towards the second side of the carrier 3, the surface portion 10 of the slat 2 adjacent to the opening 4 on the first side of the carrier 3 is brought above the shoulder 6. By subsequently releasing the slat 2, the surface portion 10 of the slat 2 adjacent to the opening 4 on the first side of the carrier 3 assumes a position resting on the shoulder 6, while the slat is allowed to pivot to an inclined position with a portion of the surface portion 9 of the slat 2 adjacent to the opening 5 on the second side of the carrier 3 resting against the support surface 8 at that second side facing away from the carrier 3. The slat 2 remains stable in this orientation, because the center of gravity of the slat 2 is at the second side of the shoulder 6 on the first side, where the slat 2 is supported. The slat 2 will thus effectively hang down from the shoulder 6 in an orientation laterally inclined downwardly to the second side, the angle of inclination being limited by a portion of the surface portion 9 of the slat 2 adjacent to the opening 5 on the second side of the carrier 3 resting against a portion of the support surface 8 at that second side.

Returning the slat 2 to the laterally horizontal orientation can be achieved very easily and quickly as well by lifting the side of the slat 2 at the second side (which can be achieved by pushing the slat 2 down at the first side as well) and laterally urging the slat 2 so that the surface portion 10 of the slat 2 adjacent to the opening 4 on the first side of the carrier 3 slips off the shoulder 6 on the first side of the carrier 3. The slat 2 will then drop to the laterally horizontal orientation or can be urged further to the oppositely inclined orientation.

For easily returning the slats 2 to the laterally horizontal orientations, it is advantageous if, as in the present example, when the slat 2 is supported in a laterally horizontal one of said positions, an upper surface of the shoulder 6 is in or above the opening 4. Thus, the slat 2 can drop from the laterally inclined position to the laterally horizontal position.

A particularly stable laterally horizontal position can be achieved if, as in the present example, each support 5 has, in addition to the support surface portion 8 on the second lateral side of the carrier 3, also a similar support surface portion 8 on the first lateral side of the carrier 3, wherein at least portions of the mutually opposite support surfaces 8 are oriented upwardly and project from the shoulder in longitudinal direction of the slats 2. The slat 2 is supported in a horizontal position in a stable manner, because the downwardly facing surface portions 9 adjacent or in the opening 4 rest on the support surfaces 8 of the support on both the first and second side of the carrier 3.

Because the slats can drop from the laterally inclined positions to the horizontal positions, the slats of the venetian blind can all be moved to the horizontal positions by holding the lower slat 2 and slightly shaking it laterally so that the carriers 3 sweep back and forth laterally. The slats 2 will then all fall back to the horizontal orientations from which selected slats 2 can easily be swept into inclined orientations, if desired. For a stable laterally horizontal position to which the slat returns easily, it is more in general advantageous if, for each slat, the center of gravity of the slat is lower when the slat is in a laterally horizontal position than when the slat is in a laterally inclined position.

Since at least a lower portion of each opening has an inner surface 10, 11 inclined and oriented in a direction upwardly converging with the carrier 3 when the slat is in the laterally horizontal position, a tight fit to the support 5 is achieved when the slat 2 is horizontal, while room is left for the support 5 when the slat 2 is tilted, so that a steep lateral inclination is allowed.

For a similar effect, it is also advantageous if, as in the present example, at least an upper portion of each opening 4 has an inner surface 12, 13 inclined and oriented in a direction downward converging with the carrier when the slat 2 is in the laterally horizontal position.

The angles of the surfaces 10-13 of the upper and/or lower portions relative to the vertical, when the slat 2 is in the laterally horizontal position, are preferably between 40 and 60 degrees.

For determining the pitch p between successive slats 2, the carriers 3 are preferably equipped with spacers 14, so that the spacing between successive slats 2 is obtained in an easy manner and not dependent in accurate fixation of supports to a carrier body.

The spacers may be integrally formed with the supports 5 (which is advantageous for easy assembly of for instance starting from a do-it-yourself kit), but for modular use of the same supports and for allowing mounting the spacers after all the supports have been mounted to carrier members, it is advantageous that the spacers 14 are separate from the supports 5 and each comprise a slit 15 communicating with a passage 16 for receiving the carrier member 17 (in the present example, a cord), for allowing the carrier member 17 to be inserted into the passage 16 laterally. Thus, the venetian blind can be provided in a compact, easily transportable form with the slats 2 and the supports 5 premounted to the cords (or other carrier members) 17 and for instance only the lowermost supports fixed to the cords 17. Just before or after installation of the venetian blind at the desired location, the spacers 14 can than be mounted laterally over the cords 17.

Since each spacer 14 has free ends mounted in portions of successive supports 5, such that lateral movement of the spacer 14 relative to the supports is prevented, the spacers reliably stay in place after having been mounted.

For efficient manufacturing, it is advantageous that each slat 2 comprises a main body 18*a*, 18*b* and slat members 19 that each bound one of the openings 4 and are mounted to the main body 18*a*, 18*b*. Thus, only small slat members 19 shaped for co-operation with the supports 5 need to be provided and can be combined with slats 2 in a wide variety of materials and designs, to accommodate a wide variation of requirements and tastes with respect to lighting, privacy and interior design. For instance, instead of slats 2 composed of a central body 18*a* and wings 18*b*, slats consisting of a single, integrally formed main body can be provided.

Since the carriers 3 provides for full support of the slats 2 in all predetermined positions, a venetian blind according to the invention can be free of carriers extending at the first or second lateral side of the slats 2.

The slats may also be supported by supports that are attached to carriers such as cords, for instance by clamping. If no spacers between successive supports are provided and the carriers are flexible, the slats may be pulled up to a relatively compact configuration, for instance by pulling up cords running alongside the carriers and attached to the lowermost slat or to a bottom bar. Instead of spacers arranged over or along a string or other load bearing elongate structure, the pitch between successive slats may for instance also be determined by providing the carriers in the form of a chains of supports and connecting elements between each pair of successive supports or in the form of a chains of supports and sets of connecting elements between each pair of successive supports, or in the form of a chain of mutually coupled supports only, the supports having integrally formed members sized in longitudinal direction of the carrier to define the pitch between successive supports.

Figure 16:
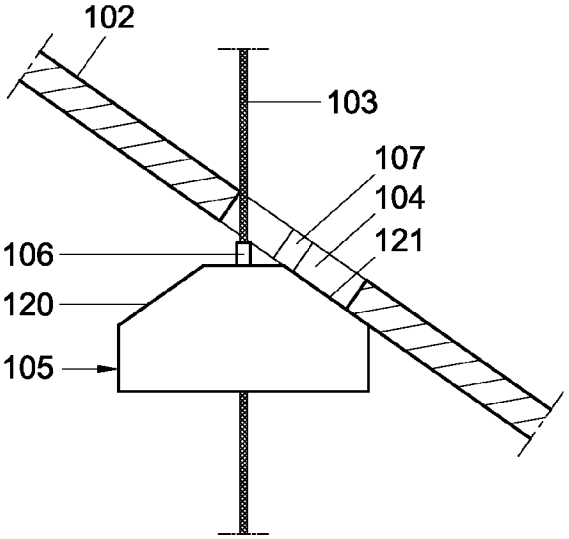
FIG. 16 is a side view according to FIG. 14 with the slat in a laterally inclined orientation.
Figure 15:
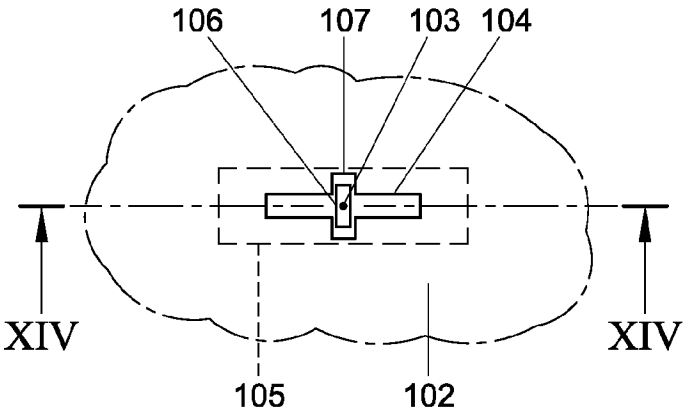
FIG. 15 is a top view of a portion of a slat of a second example of a venetian blind according to the invention.
Figure 14:
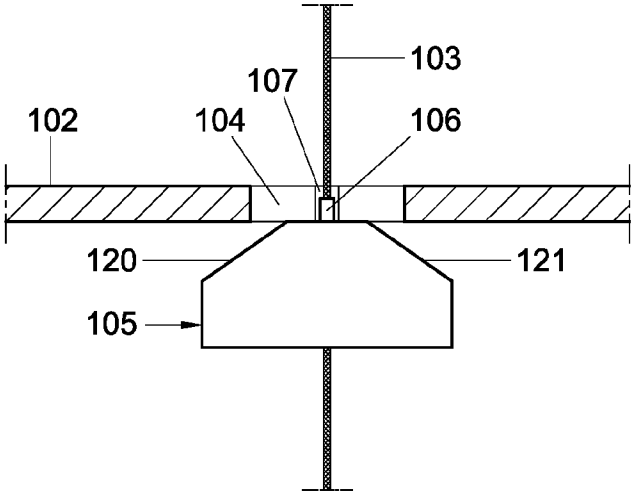
FIG. 14 is a side view in cross-section along the line XIV-XIV in FIG. 15.

In FIGS. 14-16, a portion of a second example of a venetian blind according to the invention is shown. Also in this example, the slats 102 are supported by supports 105 attached to carriers 103. The openings 104 in the slats 102 are provided in the form of cross-shaped perforations. The supports have a central projection 106 of a width smaller than the largest width of the openings 104, but larger than the smallest width of the opening 104, so that the projection only fits in the central transverse portion 107 of the opening 104. If the central projection 106 projects into the central transverse portion 107 of the opening 104, the slat 102 rests on a horizontal top surface 108 of the support as shown in FIGS. 14 and 15 and is accordingly held in a laterally horizontal position. For supporting the slat 102 in the laterally inclined position, the slat 2 can be lifted so that the upward projection 106 disengages from the central transverse portion 107 of the opening 104. The slat 102 can then be shifted and tilted laterally either to the first side or to the second side of carrier 103, to be brought in a position inclined to the second side as shown in FIG. 16 or to the first side. When the slat 102 is in the laterally inclined position, the slat 102 rests on top of the projecting portions 106 adjacent to one end of the opening 104 on one side of the carrier 103 and rests on a lower surface portion 120 or 121 on the opposite side of the carrier 103. Also in this embodiment, the slats 102 can easily be moved from a laterally horizontal position to a laterally inclined position by lateral tilting and displacement and can easily be made to drop back to the laterally horizontal position.

Figure 17:
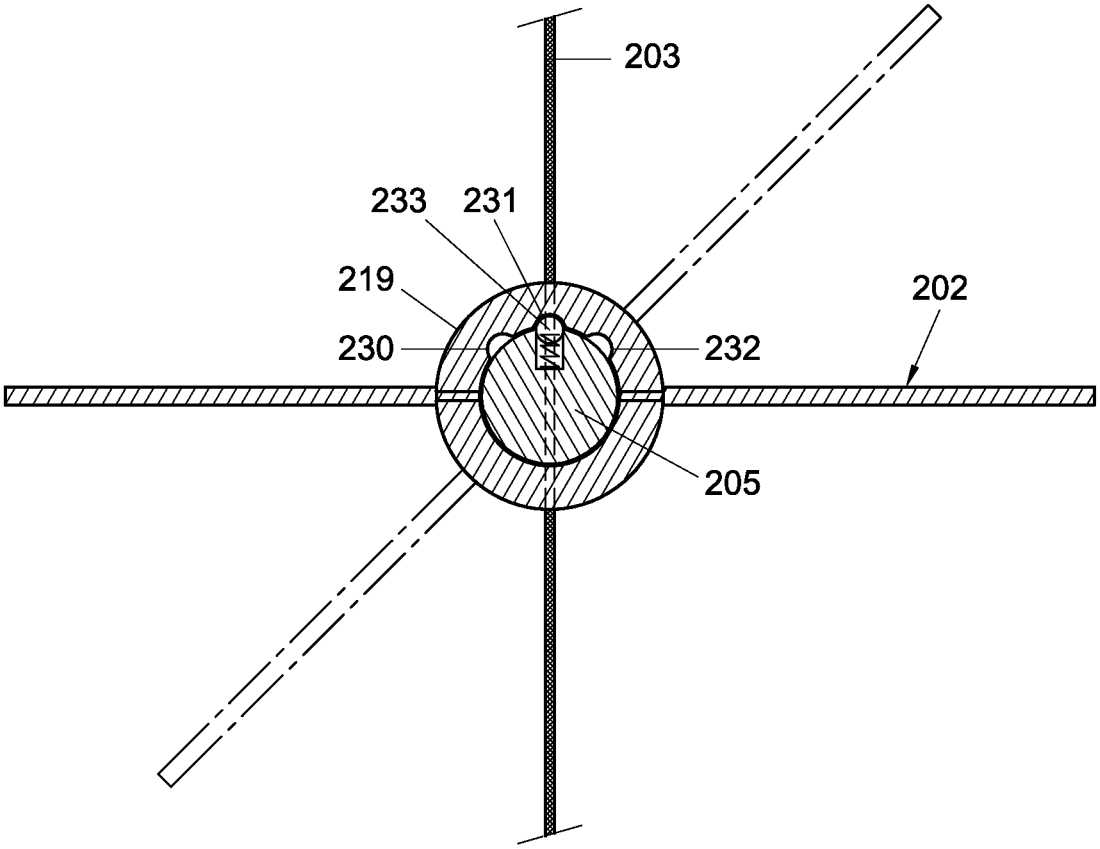
FIG. 17 is a side view in cross-section of a portion of a third example of a venetian blind according to the invention.

In FIG. 17, a portion of third example of a venetian blind according to the invention is shown in which the support 205 is fixed to a carrier 203 and includes a stub about which a slat member 219 having a bore in longitudinal direction of the slats 202 is journalled. The stub has a catch pawl 231 biased and positioned for engaging catch recesses 230, 231, 232 arranged in circumferentially spaced positions in the bore when the slat 202 is in one of three orientations defined by the recesses 230, 231, 232.

Figure 18:
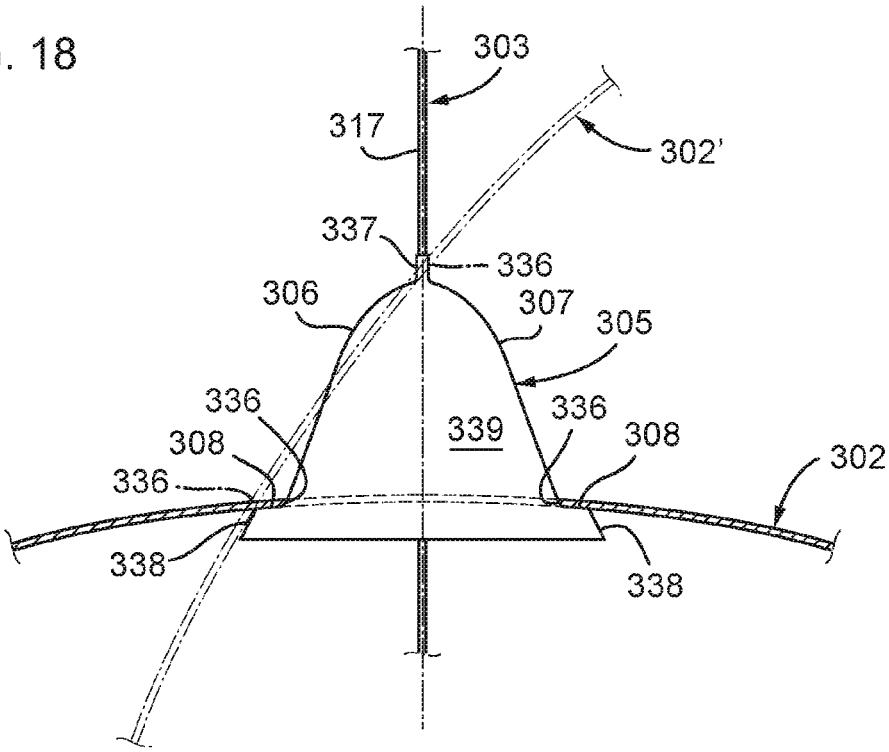
FIG. 18 is a side view in cross-section along the line XVIII-XVIII in FIG. 19 of a portion of a fourth example of a venetian blind according to the invention.
Figure 19:
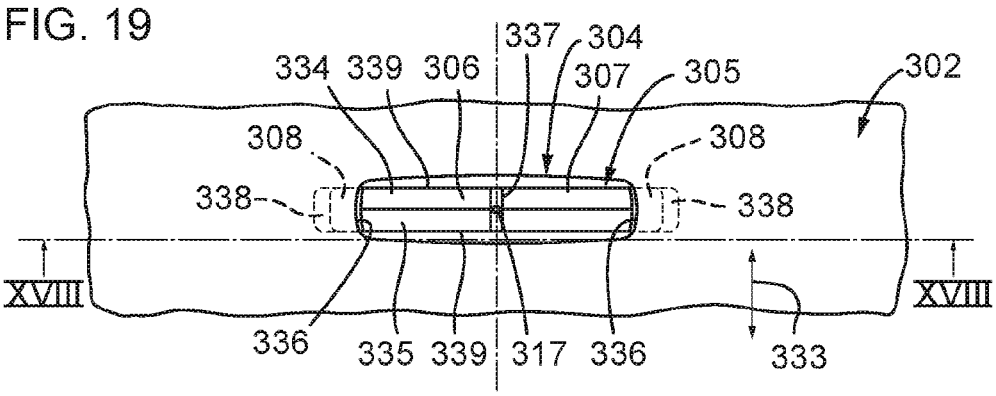
FIG. 19 is a top plan view of a portion of the venetian blind shown in FIG. 18 with a slat in a laterally horizontal position.
Figure 20:
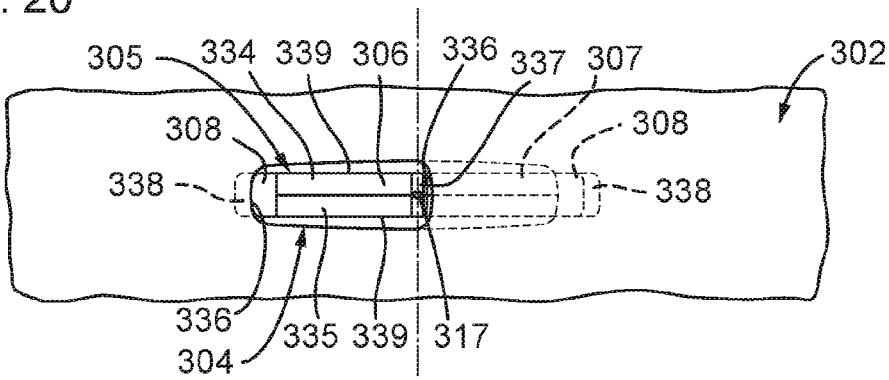
FIG. 20 is a top plan view of a portion of the venetian blind shown in FIGS. 18 and 19 with a slat in a laterally horizontal position.

In FIGS. 18-20 a fourth example of a venetian blind according to the invention is shown. The carrier 303 is composed of supports 305 (of which one is shown) fixed to a string 317 with a uniform pitch between successive supports. Slats 302 are supported by the supports 305 along edges of openings 304 formed directly in and bound by the main body of the slat 302. The opening 304 is in the form of a slit of an essentially uniform width, which can be made in the slat in an efficient manner, for instance by punching. The opening has ends 336 in longitudinal direction. The support 305 has an essentially uniform width in longitudinal direction (arrow 333 in FIG. 19) of the slat 302, so it can be molded in an efficient manner or punched out of plate material. The support is composed of two support parts 334, 335 between which the string 317 has been positioned before attaching the support parts 334, 335 to each other. The support parts may previously have been connected to each other along a folding line and have been folded against each other along the fold line.

When the slat 302 is in a laterally horizontal position, as shown in FIGS. 18 and 19, the slat 302 rests on support surfaces 308 that extend laterally of and below shoulders 306, 307. The overall lateral width of the shoulders 306, 307 at the transition to the support surfaces 308 at the lower ends of the shoulders 306, 307 is slightly smaller than the length of the opening 304 in the lateral direction from one longitudinal end 336 to the opposite end 336. This allows the slat 302 to rest in a stable, laterally horizontal position on and defined by the support surfaces 308, with the shoulders 306, 307 projecting upwardly through the opening 304. The distance between laterally outer ends of the support 305 is larger than the length of the opening 304 in the lateral direction from one longitudinal end 336 to the opposite end 336, so the slat 302 is prevented from falling off the support 305 when in a horizontal orientation.

When the slat 302 is in a laterally tilted position as indicated by reference numeral 302' in FIG. 18 and as shown in FIG. 20, one longitudinal end 336 of the opening 304 rests against the a stub 337 projecting centrally upwardly between the shoulders 306, 307. Laterally beyond the opposite longitudinal end 336 of the opening 304, the slat rests against a side surface 338 of the support that faces laterally outwardly. In this position, the slat 302 is prevented from sliding down along the side surface 338 since the upper longitudinal end 336 of the opening 304 abuts against the stub 337. The upper end portions of the shoulders 306, 307 are shaped such that the slat 302 has to slide upwardly along the side surface 338 to allow the upper longitudinal end 336 of the opening 304 to slide off the shoulder 307 (or 307 if the slat has been tilted in the opposite sense). This would entail lifting of the center of gravity of the slat 302, so the slat 302 is stably and reliably supported in the tilted position as well. Nevertheless, the slat 302 can easily be caused to move to the horizontal position by urging the slat laterally or tilting the slat 302 to a more horizontal position in which the end 336 of the opening 304 can easily slide off the shoulder 306 or 307. Tilting the slat from the laterally horizontal position to the laterally tilted position is also easily achieved by tilting the slat 302 far enough so that it slides down under the influence of gravity along a side surface 338 to a laterally displaced and tilted position with a longitudinal end 336 of the opening abutting the stub 337.

As is shown in FIG. 18, the shoulders 306, 307 are shaped such that at least a portion of a shoulder 306, 307 projects into the opening 304 over a substantial length in lateral direction of the opening regardless whether the slat is in the laterally horizontal or in the laterally inclined position. Thus, the support 307 is prevented from rotating relative to the slat 302 about the center line of the carrier 303. To this end, faces 339 of the support 305 facing in longitudinal direction of the slat 302 preferably extend closely along opposite boundary portions of the opening 304, so that the width of the support 305 in longitudinal direction of the slat 302 fits in the opening 304 with little clearance. The shape of the shoulders 306, 307 is also such that the size of the support 305 in the lateral plane in directions oblique to the horizontal is also larger than the distance between the longitudinal ends 338 of the opening 304. Thus, it is ensured that the slat 302 can also not fall off the support 305 when tilted to a laterally inclined position.

While the stub 337 projecting centrally upwardly between the shoulders 306, 307 is advantageous for protecting the string 317 against wear due to scouring of edges of the opening 304, such a stub may also be left out, so that the slat rests directly against the string 317.

The invention claimed is:

1. A venetian blind comprising:

a plurality of elongate slats positioned in a horizontal direction, the plurality of slats being suspended via and evenly distributed along elongate carriers with a vertical component positioned in a vertical direction, so as to form a window cover having a horizontal size determined by a length of the slats and a vertical size that is perpendicular thereto and determined by a length of the carriers, wherein the carriers extend through openings in the elongate slats wherein supports are positioned with a pitch along the carriers, each support supporting one of the elongate slats adjacent to its opening, the openings and the supports being arranged for providing stable support for each of the slats in at least two, mutually distinct positions, at least one of the positions being a laterally inclined position wherein the respective slat is tilted about an axis in the horizontal direction of the elongate slats, and wherein each support has at least one shoulder at a first lateral side of the carrier and a first support surface lower than said shoulder at a second, opposite lateral side of the carrier, and wherein, while at least one of the slats is supported by its support in the laterally inclined position, a surface portion of said slat adjacent to the opening on said first side of the carrier rests on said shoulder and a surface portion of said slat adjacent to the opening on said second side of the carrier rests against said first support surface.

2. The venetian blind according to claim 1, wherein the slats are each movable between said at least two, mutually distinct positions by lateral movement transverse to the carrier and by lateral tilting about the axis in the horizontal direction of the elongate slats.

3. The venetian blind according to claim 1, wherein at least one of the positions for the slats is a laterally horizontal position wherein a surface of the respective slat extends parallel to the axis in the horizontal direction of the elongate slats, and wherein, while at least one of the slats is supported in the laterally horizontal position, an upper surface of said shoulder is in or above said opening of that slat.

4. The venetian blind according to claim 1, wherein an upper portion of said shoulder is configured to be in or above said opening when the slat is supported in the laterally inclined position and when the slat is supported in a laterally horizontal position.

5. The venetian blind according to claim 1, wherein each support comprises, in addition to said first support surface on said second, opposite lateral side of said carrier, a second support surface on said first lateral side of said carrier configured to support a surface of its adjacent slat, wherein at least portions of said mutually opposite support surfaces project from said shoulder in a longitudinal direction of said slats.

6. The venetian blind according to claim 1, wherein at least one downwardly facing surface of at least one of the slats that is in or adjacent to said opening rests on the support surface of the support in a position aside said at least one shoulder.

7. The venetian blind according to claim 1, wherein each opening is in the form of a slit having a constant width in a longitudinal direction of the slats, wherein each support has a largest size in the longitudinal direction of the slat that is smaller than said width, and wherein each slit has a length in a direction perpendicular to said longitudinal direction that is smaller than a smallest size of said support perpendicular to said longitudinal direction.

8. The venetian blind according to claim 5, wherein each opening is in the form of a slit having a constant width in a longitudinal direction of the slats, wherein each support has a largest size in the longitudinal direction of the slat that is smaller than said width, and wherein each slit has a length in a direction perpendicular to said longitudinal direction that is smaller than a smallest size of said support perpendicular to said longitudinal direction.

9. The venetian blind according to claim 1, wherein at least a lower portion of each opening has an inner surface inclined and oriented in a direction upwardly converging with the carrier when the slat is in a laterally horizontal one of said positions.

10. The venetian blind according to claim 1, further comprising spacers for determining a pitch between successive slats.

11. The venetian blind according to claim 10, wherein the spacers are separate from the supports and each comprise a slit communicating with a passage for receiving a carrier member, for allowing the carrier member to be inserted into the passage laterally.

12. The venetian blind according to claim 11, wherein each spacer has free ends mounted in or over portions of successive supports such that lateral movement of the spacers relative to the supports is prevented.

13. The venetian blind according to claim 1, wherein each slat comprises a main body and slat members each bounding one of said openings and mounted to said main body.

14. The venetian blind according to claim 1, wherein, for each slat, the center of gravity of said slat is lower when said slat is in a laterally horizontal position wherein a surface of the respective slat extends parallel to the axis in the horizontal direction of the elongate slats than when in the laterally inclined position.

15. The venetian blind according to claim 1, wherein one or more of the slats are free of carriers extending at the first or second lateral side of said slats.

* * * * *